US010689735B2

(12) United States Patent
Jang et al.

(10) Patent No.: US 10,689,735 B2
(45) Date of Patent: Jun. 23, 2020

(54) HIGH STRENGTH STEEL SHEET HAVING EXCELLENT CRYOGENIC TEMPERATURE TOUGHNESS AND LOW YIELD RATIO PROPERTIES, AND METHOD FOR MANUFACTURING SAME

(71) Applicant: POSCO, Pohang-si (KR)

(72) Inventors: Sung-Ho Jang, Pohang-si (KR); Woo-Gyeom Kim, Pohang-si (KR); Ki-Hyun Bang, Pohang-si (KR)

(73) Assignee: POSCO, Pohang-si (KR)

( * ) Notice: Subject to any disclaimer, the term of this patent is extended or adjusted under 35 U.S.C. 154(b) by 628 days.

(21) Appl. No.: 14/654,649

(22) PCT Filed: Dec. 28, 2012

(86) PCT No.: PCT/KR2012/011747
§ 371 (c)(1),
(2) Date: Jun. 22, 2015

(87) PCT Pub. No.: WO2014/104443
PCT Pub. Date: Jul. 3, 2014

(65) Prior Publication Data

US 2015/0315682 A1 Nov. 5, 2015

(30) Foreign Application Priority Data

Dec. 27, 2012 (KR) ..... 10-2012-0155231

(51) Int. Cl.
*C22C 38/16* (2006.01)
*C21D 6/00* (2006.01)
(Continued)

(52) U.S. Cl.
CPC ..... *C22C 38/16* (2013.01); *C21D 6/001* (2013.01); *C21D 6/005* (2013.01); *C21D 6/008* (2013.01);
(Continued)

(58) Field of Classification Search
CPC ..... C21D 9/46; C21D 8/0205; C21D 8/0263; C21D 6/001
See application file for complete search history.

(56) References Cited

U.S. PATENT DOCUMENTS 4,466,842 A 8/1984 Yada et al.
6,221,178 B1 4/2001 Torizuka et al.
(Continued)

FOREIGN PATENT DOCUMENTS

CA 2693963 1/2009
CA 2764663 12/2010
(Continued)

OTHER PUBLICATIONS

Canadian Search Report—Canadian Application No. 2,896,531, dated Sep. 28, 2016.
(Continued)

*Primary Examiner* — Colleen P Dunn
*Assistant Examiner* — Jeremy C Jones
(74) *Attorney, Agent, or Firm* — Cantor Colburn LLP

(57) ABSTRACT

A high strength steel sheet comprises 0.02 to 0.12 wt % of carbon (C), 0.5 to 2.0 wt % of manganese (Mn), 0.05 to 0.5 wt % of silicon (Si), 0.05 to 1.0 wt % of nickel (Ni), 0.005 to 0.1 wt % of titanium (Ti), 0.005 to 0.5 wt % of aluminum (Al), 0.015 wt % or less of phosphorus (P), 0.015 wt % or less of sulfur (S), and the balance of Fe and other inevitable impurities. The microstructure thereof includes 70% to 90% of ultrafine ferrite and 10% to 30% of MA (martensite/austenite) structure by area fraction, and the yield ratio (YS/TS) thereof is 0.8 or less.

14 Claims, 2 Drawing Sheets

(51) Int. Cl.

| | |
|---|---|
| ***C21D 8/02*** | (2006.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/08*** | (2006.01) |
| ***C22C 38/00*** | (2006.01) |
| ***C22C 38/20*** | (2006.01) |

(52) U.S. Cl.
CPC ..... *C21D 8/0205* (2013.01); *C21D 8/0263* (2013.01); *C21D 9/46* (2013.01); *C22C 38/00* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/20* (2013.01)

(56) References Cited

U.S. PATENT DOCUMENTS

| | | | | |
|---|---|---|---|---|
| 6,572,716 | B2 | 6/2003 | Hayashi et al. | |
| 2004/0202889 | A1* | 10/2004 | Fujita | C23C 2/02 428/659 |
| 2006/0151074 | A1* | 7/2006 | Ishikawa | C22C 38/02 148/661 |
| 2009/0301613 | A1* | 12/2009 | Koo | C22C 38/02 148/537 |
| 2010/0258219 | A1 | 10/2010 | Ahn et al. | |
| 2010/0263773 | A1 | 10/2010 | Cho et al. | |
| 2011/0002808 | A1* | 1/2011 | Mizoguchi | C21D 1/25 420/83 |
| 2011/0126944 | A1* | 6/2011 | Kami | C21D 1/25 148/504 |
| 2012/0241057 | A1* | 9/2012 | Shimamura | C21D 6/005 148/645 |

FOREIGN PATENT DOCUMENTS

| | | | |
|---|---|---|---|
| CA | 2869340 | | 10/2013 |
| CN | 101868560 | | 10/2010 |
| EP | 1662014 | | 5/2006 |
| JP | 09296253 | | 11/1997 |
| JP | 09316534 | | 12/1997 |
| JP | 10017982 | | 1/1998 |
| JP | 2000290748 | | 10/2000 |
| JP | 2008214764 | | 9/2008 |
| JP | 2008240004 | | 10/2008 |
| JP | 2008240004 | A * | 10/2008 |
| JP | 2008261046 | | 10/2008 |
| KR | 1019990029986 | | 4/1999 |
| KR | 1019990029987 | | 4/1999 |
| KR | 1020040059579 | | 7/2004 |
| KR | 1020040059581 | | 7/2004 |
| KR | 100833076 | | 5/2008 |
| KR | 100833076 | B1 * | 5/2008 |
| KR | 1020090119263 | | 11/2009 |
| KR | 1020110046690 | | 5/2011 |

OTHER PUBLICATIONS

International Search Report—PCT/KR2012/011747 dated Jul. 3, 2013.
Chinese Office Action—Chinese Application No. 201280078067.6 dated Mar. 4, 2016.
European Search Report—European Application No. 12891147.6 dated Dec. 3, 2015.

* cited by examiner

HIGH STRENGTH STEEL SHEET HAVING EXCELLENT CRYOGENIC TEMPERATURE TOUGHNESS AND LOW YIELD RATIO PROPERTIES, AND METHOD FOR MANUFACTURING SAME

TECHNICAL FIELD

The present disclosure relates to a high strength steel sheet having low yield ratio properties and excellent cryogenic temperature toughness, in which the high strength steel sheet is suitable for use as a steel, for tanks used for the storage of gas or the like, for example, due to these properties and a method for manufacturing the same.

BACKGROUND ART

Due to environmental regulations being strengthened because of global warming, there is growing interest in the handling of $CO_2$. Therefore, an industry for storing and transporting $CO_2$ and then burying $CO_2$ in offshore oilfields is being established. Accordingly, demand for steel for tanks used for liquefying and storing $CO_2$ gas is rapidly increasing.

At least 7 bars of pressure are required to liquefy $CO_2$ gas. Since gas tanks for liquefying $CO_2$ gas are designed to withstand temperatures of −60° C. or less, the steel for the gas tanks requires high strength so as to bear high pressure and resist external impacts, and also, the steel requires sufficient toughness, even at a low gas temperature. Specifically, according to classification rules, the steel used for the gas tanks is required to have excellent low temperature toughness, even at a temperature of −75° C. or less.

In addition, when gas tanks are manufactured by welding steel, it is important to remove stress from a welding zone. Therefore, as a method for removing residual stress from welding zones, there are provided a Post Welding Heat Treatment (PWHT) method using a heat treatment and a Mechanical Stress Relief (MSR) method for removing residual stress by spraying high-pressure water onto a welding zone. Among these methods, when stress in a welding zone is removed using the MSR method, a base metal zone may be deformed by the water impact, and thus, the yield ratio of the base metal is limited to 0.8 or less. In greater detail, when a level of yield strength sufficient to create deformation or more is applied to a base metal zone due to spraying high-pressure water for removing stress using the MSR method, the ratio of yield strength to tensile strength is relatively high, thereby generating the deformation; that is, reaching the tensile strength, and thus, it is possible to generate breakages. Therefore, the difference between the yield strength and tensile strength is limited to be great.

In particular, since gas tanks should be enlarged, it is difficult to remove stress therefrom using the PWHT method. Therefore, the MSR method is being used at most shipbuilding companies, and thus, steel for manufacturing gas tanks requires a low yield ratio.

Meanwhile, as methods for improving the strength of steel, which is one of the properties required in steel, there are precipitation hardening, a solid-solution hardening, a martensite hardening, and the like. However, these methods are used for strength to be improved but possess disadvantages in that there is a deterioration of toughness.

However, in the case of grain boundary strengthening, it is possible to obtain high strength, and furthermore, it is possible to prevent the deterioration of toughness due to a decrease in an impact toughness transition temperature.

As an example, Patent Documents 1 and 2 suggest a technique involved in the improvements of strength and toughness by refining crystal grains, specifically, a method for refining crystal grains of ferrite by refining crystal grains of austenite. However, there are problems in that the manufacturing conditions therefor are complicated, and also, the effect on refining ferrite is less effective.

In addition, Patent Documents 3 to 7 relate to the techniques involved in the refinement of ferrite due to the heavy rolling of a non-recrystallization region. Among the documents, Patent Document 3 suggests a method for refining ferrite by performing compression processing of 30% or more of a reduction ratio at the temperature range of an austenite non-recrystallization region and then an accelerated cooling during cooling of the heated low carbon steel after heating the low carbon steel. Patent Document 4 suggests a method of implementing the refinement of ferrite, in which the method includes first heat treating a general carbon steel to be a martensite structure and reheating the general carbon steel at the ferrite stable temperature range to process with 50% or more of a reduction ratio per pass. In addition, Patent Documents 5 and 6 suggest a method for implementing micro ferrite, in which the method includes limiting an austenite crystal grain size to be a fixed size by static recrystallization, and rolling with 30% or more reduction ratio per pass in the austenite non-recrystallization region. Patent Document 7 suggests a method for refining ferrite with the reheated low carbon steel at 75% or more of the total reduction ratio through a single-pass or multi-pass around the $Ar_3$ temperature, and for 1 second as a processing time for a rolling pass.

However, these techniques require large reduction per pass in the rolling process that is the main process for manufacturing steel, and in which the time per pass is limited. Therefore, the techniques possess difficult manufacturing conditions. In order to implement these techniques practically, the installations of extra-large rolling apparatuses and control systems are required, and thus, it is difficult to implement them with the existing apparatuses.

The above techniques are involved in the improvements of strength and toughness by refining crystal grains, and thus, when the refinement of ferrite crystal grains is implemented according to these techniques, tensile strength and yield strength are both improved, and thereby, it is impossible to implement a low yield ratio.

(Patent Document 1) Japanese Patent Laid-Open Publication No. 1997-296253

(Patent Document 2) Japanese Patent Laid-Open Publication No. 1997-316534

(Patent Document 3) Korean Patent Publication No. 1999-0029986

(Patent Document 4) Korean Patent Publication No. 1999-0029987

(Patent Document 6) Korean Patent Publication No. 2004-0059579

(Patent Document 5) Korean Patent Publication No. 2004-0059581

(Patent Document 7) U.S. Pat. No. 4,466,842

DISCLOSURE

Technical Problem

An embodiment of the present disclosure is directed to a high strength steel sheet having improved strength and toughness, low yield ratio properties, and a method for manufacturing the same.

Technical Solution

An aspect of the present disclosure is to provide a high strength steel sheet including 0.02 to 0.12 wt % of carbon (C), 0.5 to 2.0 wt % of manganese (Mn), 0.05 to 0.5 wt % of silicon (Si), 0.05 to 1.0 wt % of nickel (Ni), 0.005 to 0.1 wt % of titanium (Ti), 0.005 to 0.5 wt % of aluminum (Al), 0.015 wt % or less of phosphorus (P), 0.015 wt % or less of sulfur (S), and the balance of Fe and other inevitable impurities, in which the microstructure thereof includes 70% to 90% of ultrafine ferrite and 10% to 30% of MA (martensite/austenite) structure by area fraction, and a yield ratio (YS/TS) of 0.8 or less.

Another aspect of the present disclosure is to provide a method of manufacturing a high strength steel sheet, in which the method includes: heating a slab including the above-described composition; rough-rolling the heated slab to control an average crystal grain size of austenite to be 40 μm or less; forming the matrix structure of the slab to be ultrafine ferrite having an average crystal grain size of 10 μm or less by finished-rolling the slab after being subjected to the rough-rolling; maintaining the slab for 30 to 90 seconds after being subjected to the finished-rolling; and forming 10% to 30% of fine martensite/austenite (MA) having 5 μm or less of an average grain size by area fraction in an ultrafine ferrite matrix by cooling the slab after being subjected to the maintaining, in which the yield ratio (YS/TS) thereof is 0.8 or less.

Advantageous Effects

In the case of satisfying the component composition and manufacturing conditions according to the present invention, it is possible to provide a high strength steel sheet having excellent toughness by having 150 J or more of an impact toughness value at −75° C., obtaining high strength, that is, 530 MPa or more of tensile strength, and implementing 0.8 or less of a low yield ratio, at the same time.

BEST MODE

Figure 1:
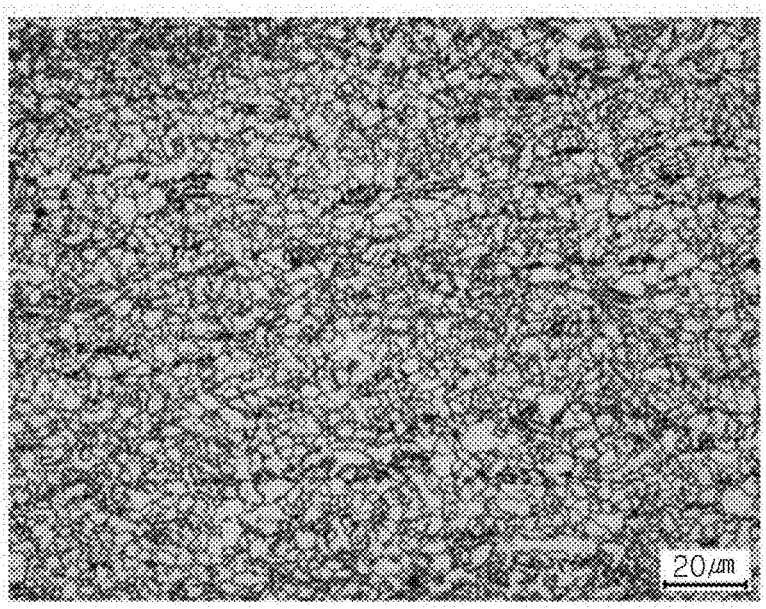
FIG. 1 illustrates the result of observing the ultrafine ferrite shapes of Invented Material B1 with a microscope.

The present invention relates to a steel sheet having high strength and high toughness, and also, a low yield ratio, by controlling the component composition and microstructure of steel and also applying a rolling condition using a dynamic recrystallization (SIDT: Strain Induces Dynamic Transformation) that is one of the crystal grain refinement methods, and a method of manufacturing the steel sheet.

According to an embodiment of the present invention, a high strength steel sheet includes 0.02 to 0.12 wt % of carbon (C), 0.5 to 2.0 wt % of manganese (Mn), 0.05 to 0.5 wt % of silicon (Si), 0.05 to 1.0 wt % of nickel (Ni), 0.005 to 0.1 wt % of titanium (Ti), 0.005 to 0.5 wt % of aluminum (Al), 0.015 wt % or less of phosphorus (P), 0.015 wt % or less of sulfur (S), and the balance of Fe and other inevitable impurities.

Hereinafter, the range of the component composition of the present invention and the reason of limiting the range will be described in detail (wt %).

C: 0.02 to 0.12 wt %

Carbon (C) is a necessary element to be included in a suitable amount for effectively strengthening steel. In the present invention, carbon generates an MA phase (martensite/austenite mixed structure), and is the most important element for determining the size and fraction of the MA phase to be formed. Therefore, it should be included in a proper range. When the content of C exceeds 0.12%, it generates a decrease in low temperature toughness and forms too many MA phases, thereby making the fraction thereof higher than 30%, and thus, it is unfavorable. Meanwhile, when the content of C is less than 0.02%, it generates too few MA phases, and thus, makes the fraction thereof less than 10%, thereby decreasing strength and also yield ratio. Therefore, it is unfavorable. Accordingly, in the present invention, it is preferable to limit the content of C to 0.02% to 0.12%.

Mn: 0.5 to 2.0 wt %

Manganese (Mn) contributes ferrite refinement, and is a useful element for improving strength through a solid solution hardening. Therefore, Mn should be added in the amount of 0.5% or more in order to obtain its effect. However, when the content thereof exceeds 2.0%, the hardenability is excessively increased, thereby greatly decreasing the toughness of a welding zone, and thus, it is unfavorable. Therefore, in the present invention, it is preferable to limit the content of Mn to 0.5% to 2.0%.

Si: 0.05 to 0.5 wt %

Silicon (Si) has an effect on increasing strength by the effect of a solid solution hardening, and is used as a deoxidizer in the steel manufacturing process. When the content of Si exceeds 0.5%, it generates a decrease in low temperature toughness and deteriorated weldability. Therefore, it is necessary to limit the content thereof to 0.5% or less. However, when the content thereof is less than 0.05%, the deoxidation effect is insufficient, and it is difficult to obtain an effect of improving strength, and thus, it is unfavorable. In addition, Si generates an increase in the stability of MA (martensite/austenite mixed structure), and thus, even though the content of C is low, it forms many fractions of the MA phases. Therefore, it helps to improve strength and implement a low yield ratio. However, when the MA phases are excessively formed, it causes a decrease in toughness. Therefore, in consideration of these points, the preferred range of the content of Si is limited to 0.1% to 0.4%.

Ni: 0.05 to 1.0 wt %

Nickel (Ni) is almost the only element capable of improving the strength and toughness of a base metal at the same time. In order to obtain the above-described effect, Ni should be added in the amount of 0.05% or more. However, Ni is an expensive element, and when the content thereof exceeds 1.0%, there is a problem in that using nickel is not economically feasible.

In addition, at the time of adding Ni, it generates a decrease in $Ar_3$ temperature, and thus, a rolling at a low temperature is required to generate an SIDT. In this case, deformation resistance is increased at the time of rolling, and thus, it is difficult to perform the rolling. Therefore, in consideration of these points, it is preferable to limit the maximum amount of Ni to 1.0% or less.

Ti: 0.005 to 0.1 wt %

Titanium (Ti) generates form oxide and nitride in steel to suppress the growth of crystal grains at the time of re-heating, thereby greatly improving low temperature toughness. Therefore, in order to obtain these effects, Ti should be added in the amount of 0.005% or more. However, when the content thereof exceeds 0.1%, there is a problem in that the low temperature toughness is decreased due to the center crystallization and nozzle clogging in continuous casting. Therefore, it is preferable to limit the content of Ti to 0.005% to 0.1%.

Al: 0.005 to 0.5 wt %

Aluminum (Al) is an element useful in the deoxidation of melting steel, and for this reason, it is necessary to be included in an amount of 0.005% or more. However, when the content thereof exceeds 0.5%, nozzle clogging in continuous casting occurs, and thus, it is unfavorable.

In addition, a solid-solutionized Al works the formation of the MA phase (martensite/austenite mixed structure), and thus, it creates many MA phases even with a small amount of C, thereby helping the improvement of strength and the implementation of a low yield ratio. Therefore, in consideration of these points, it is preferable to limit the content range of Al to 0.01% to 0.05%.

P: 0.015% or less

Phosphorous (P) is an element for causing grain boundary segregation at a base metal and a welding zone, but may generate the problem of steel embrittlement. Therefore, the amount of the phosphorous should be actively decreased. However, in order to decrease P to the utmost minimum, the overload of a steel manufacturing process is intensified. When the content of P is 0.020% or less, the above-described problem does not occur. Therefore, the maximum thereof is limited to 0.015%.

S: 0.015% or less

Sulfur (S) is an element for causing red shortness, but generates a great decrease in impact toughness by forming MnS, and the like. Therefore, it is preferable to control the content thereof to be kept as low as possible, and thus, the content thereof is limited to 0.015% or less.

The steel having the component composition useful to the present invention as described above includes the alloy elements in the above-described content ranges to obtain the sufficient effects. However, it is preferable to add the following alloy elements in the proper ranges in order to further improve the properties, the strength and toughness of steel, and the toughness and weldability of a welding heat-affected zone. At this time, the following alloy elements may be singularly added or added in a combination of two or more types.

Cu: 0.01 to 0.5 wt %

Copper (Cu) is an element for minimizing the decrease in toughness of a base metal and also for simultaneously increasing strength. In order to obtain these effects, Cu should be added in the amount of 0.01% or more. However, when Cu is excessively added, the quality of the surface of a product is greatly inhibited, and thus, it is preferable to limit the content thereof to 0.5% or less.

Nb: 0.005 to 0.1 wt %

Niobium (Nb) greatly improves the strengths of a base metal and a welding zone by precipitating it into a type of NbC or NbCN. In addition, at the time of being re-heated at a high temperature, a solid-solutionized Nb is generated to inhibit the recrystallization of austenite and inhibit the transformation of ferrite or bainite, and thereby it has an effect on refining the structure. Furthermore, even at the time of cooling after a final rolling, it generates a great increase in stability of austenite, and thus, promotes the production of the MA phase (martensite/austenite mixed structure). Therefore, in order to obtain these effects, Nb should be added in the amount of 0.005% or more. However, when the content thereof exceeds 0.1%, the possibility of causing brittleness cracks at the edges of steel is increased, and thus, it is unfavorable.

Mo: 0.005 to 0.5 wt %

Molybdenum (Mn) greatly improves hardenability even with a small amount thereof, and thus, is a useful element to be applied. In order to obtain the above-described effects, the content thereof should be added in an amount of 0.005% or more. However, Mo is an expensive element, and when it exceeds 0.5%, the hardness of a welding zone is excessively increased, and the toughness is inhibited. Therefore, it is preferable to limit the content thereof to 0.5% or less.

Hereinafter, the microstructure of the steel of the present invention, which has the above-described component composition, will be described in detail.

Preferably, the microstructure of the steel provided in the present invention includes 70% to 90% of ultrafine ferrite having 10 μm or less of a crystal grain size by area fraction, and 10% to 30% of the MA (martensite/austenite) structure having 5 μm or less of an average grain size by area fraction.

When ultrafine ferrite is formed in the area rate of 70% or more as a microstructure according to the present invention, the strength is increased by the crystal grain refinement and the impact transition temperature is decreased, and thereby, it is useful to secure toughness at a cryogenic temperature. In addition, when the fine MA phases (martensite/austenite mixed structure) are evenly distributed in the area rate of 10% or more, continuous yield behavior is generated by mobile dislocation formed on the interface of the MA phase and ferrite structure, and the strain hardening rate is increased to obtain a low yield ratio. Furthermore, in the case of the MA phase, it generates a decrease in yield strength but contributes to an increase in tensile strength, and thus, it is very useful in order to implement high strength and a low yield ratio.

In order to implement the above-described microstructure, a manufacturing condition should be controlled, and in particular, it is important to optimize the rolling pass conditions and cooling conditions.

Hereinafter, the conditions for manufacturing the steel provided in the present invention will be described in detail.

The process of manufacturing the steel according to the present invention includes: slab re-heating—rough-rolling—finished-rolling—cooling. The detailed conditions for the respective processes are as follows.

Slab re-heating temperature: 1000° C. to 1200° C.

For re-heating the slab that satisfies the above-described component composition in the present invention, the re-heating is preferably performed at 1000° C. or higher, for the purpose of sufficiently solid-solutionizing Ti carbonitride formed in a casting. In addition, when the temperature of heating a slab is too low, the deformation resistance at the time of rolling is too high, and thus, it is difficult to apply a reduction ratio per pass in the rolling process. Therefore, the minimum thereof is preferably limited to 1000° C. However, when re-heating is performed at an excessively high temperature that exceeds 1200° C., the austenite crystal grains are subjected to an excessive coarsening, thereby decreasing toughness, and thus, it is unfavorable.

Rough-rolling temperature: 1200° C. to austenite recrystallization temperature (Tnr)

The rough-rolling that is performed after the re-heating is an important process in the present invention. In the present invention, by optimizing the conditions at the time of rough-rolling, it is likely that the refinement of initial austenite crystal grains is implemented. When the initial austenite crystal grains are refined, the austenite crystal grain fraction that acts as a site of producing the ferrite nuclei is increased to easily form the ferrite nuclei, thereby decreasing the grain boundary deformation that is required for generating SIDT and moving the ferrite transformation temperature to a high temperature.

Therefore, according to the present invention, the rough-rolling temperature may be controlled to be 1200° C. to austenite recrystallization temperature (Tnr); the rolling at this recrystallization rolling step may be controlled to be 15% or more of the reduction ratio per pass and may be performed to be 30% or more of the accumulated reduction ratio; and thus, the crystal grain size of initial austenite may be controlled to be 40 μm or less. As described above, through the refinement of initial austenite crystal grain size, it is possible to minimize the critical deformation that is required for generating SIDT.

Finished-rolling temperature: $Ar_3$+30° C. to $Ar_3$+100° C.

Along with the rough-rolling, the finished-rolling that is performed after the rough-rolling is the most important technical factor in the present invention. In the present invention, by optimizing the conditions at the time of the finished-rolling, ultrafine ferrite through SIDT may be formed.

The critical deformations for SIDT generation are different from each steel component, but it is possible to generate SIDT when the effective reduction ratio is of a critical value or more. Therefore, in the present invention, the finished-rolling temperature is limited to $Ar_3$+30° C. to $Ar_3$+100° C. to provide the critical deformation. When the finished-rolling temperature exceeds $Ar_3$+100° C., it is difficult to obtain ultrafine ferrite through SIDT. Meanwhile, when it is less than $Ar_3$+30° C., coarse free ferrite is formed along with the austenite crystal grains during rolling, thereby performing the two-phase region rolling. Therefore, in this case, strength and impact toughness may be decreased, and thus, it is unfavorable.

In addition, it is preferable that the reduction ratio per rolling pass at the time of finished-rolling at the finished-rolling temperature is maintained to be 10% or more, and the rolling is performed to be 60% or more of the accumulated reduction ratio. The reduction ratio per rolling pass at the time of finished-rolling is less than 10%, and it is difficult to provide the sufficient critical deformation to generate SIDT, and thereby it is difficult to obtain ultrafine ferrite. In addition, when the accumulated reduction ratio is less than 60%, it is difficult to obtain a sufficient fraction of ultrafine ferrite through SIDT, and thus, it is impossible to refine the structure.

Therefore, according to the suggestion of the present invention, it is preferable to perform finished-rolling. In the case of controlling the rolling as described above, it is possible to obtain ultrafine ferrite having 10 μm or less of a crystal grain size.

Cooling condition after rolling: cooling to 300° C. to 500° C. at the cooling rate of 10° C./s or more after maintaining the temperature for stopping the finished-rolling for 30 to 90 seconds Subsequently, the steel that is rolled as described above is subjected to cooling, but it is preferable to maintain the temperature for stopping the finished-rolling for about 30 to 90 seconds before being cooled.

Figure 3:
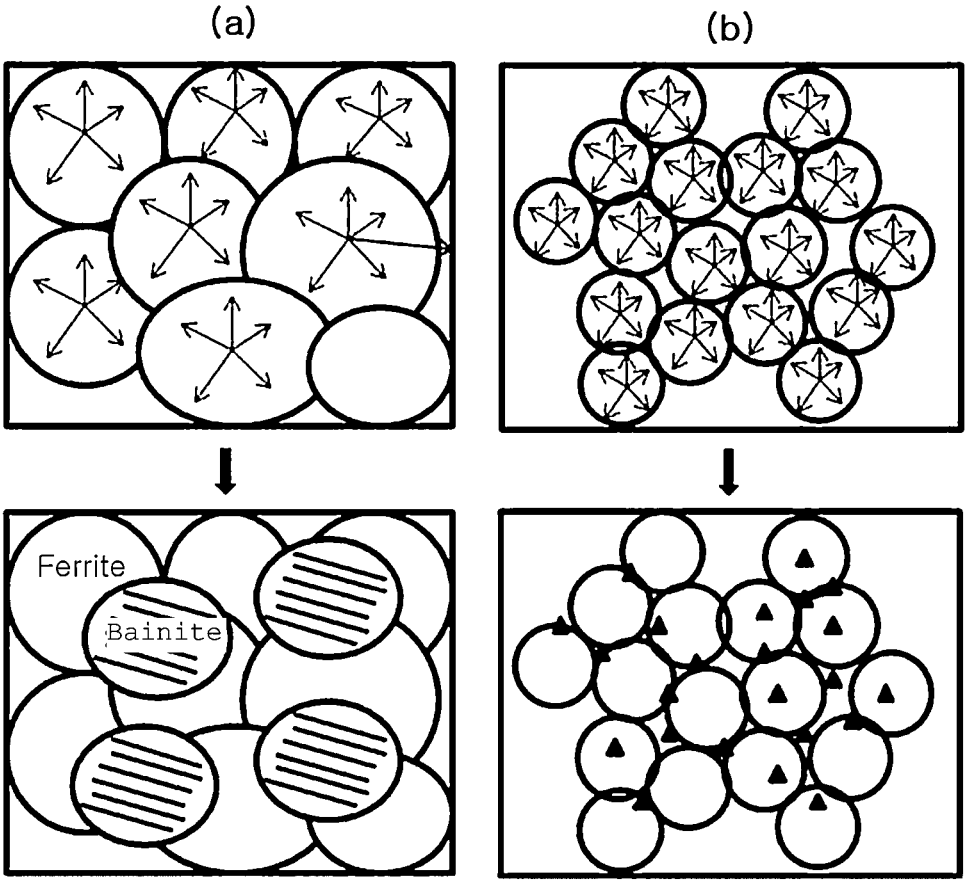
FIG. 3 is a mimetic diagram illustrating the process of forming an MA phase, in which (a) is conventional steel and (b) is the invented steel according to the present invention.

In general, the MA phases (martensite/austenite mixed structure) are generated at the time of cooling in the area with high-concentrated solid-solutionized elements. Referring to FIG. 3, in the case of conventional steel, coarse ferrite is formed by performing cooling immediately after rolling, the distance that the solid-solutionized elements in the crystal grains move to the grain boundary is increased, and the moving time is lacking, and thereby it is difficult to form an area with high-concentrated solid-solutionzed elements. Therefore, after completing the cooling, secondary phases like coarse bainite are formed so as to decrease the low temperature impact toughness. However, by performing the step of maintaining the temperature for stopping the finished-rolling for the fixed time according to the present invention, the time of moving solid-solutionized elements is sufficiently provided, thereby forming many areas with high-concentrated solid-solutionized elements in the grain boundary of a site. Therefore, it is possible to form many MA phases at the time of being cooled.

In addition, the cooling rate is controlled to be 10° C./s or more at the time of being cooled and the temperature for stopping the cooling is controlled to be 300° C. to 500° C. When the cooling rate is less than 10° C./s, the coarse pearlite as a secondary phase is formed to inhibit the impact toughness. Particularly, it is difficult to obtain an MA phase, and thus, it is impossible to implement a low yield ratio. In addition, when the temperature of stopping the cooling exceeds 500° C., it is possible to make the fine ferrite coarse, and thus, to cause impact toughness to decrease. In addition, the MA phase formed as a secondary phase may be coarse, and the fraction thereof may not be sufficiently secured, and thereby, it is impossible to implement a low yield ratio. Meanwhile, when the temperature of stopping the cooling is less than 300° C., a martensite phase is formed as a secondary phase, and thus, it is possible to decrease the toughness of steel. Therefore, in the present invention, it is preferable to limit the temperature of stopping the cooling to 300° C. to 500° C.

When the cooling is performed according to the above-described conditions, it is possible to obtain the structure having 10% to 30% of MA phases having 5 μm or less of an average grain size as a secondary phase by area fraction, which is distributed in the ultrafine ferrite matrix.

The steel sheet manufactured by completing the cooling may be manufactured to have 8 t to 80 t of thickness thereof.

Hereinafter, the present invention will be described in more detail with reference to Examples. However, the examples are only for illustrating the present invention and are not limited to the present invention. The correct range of the present invention is determined by the contents disclosed in Claims and the contents that are rationally inferred thereby.

EXAMPLES

The respective steels having the component composition listed in the following Table 1 were manufactured as slabs. Subsequently, the respective slabs were re-heated at 1000° C. to 1200° C.; were subjected to a rough-rolling at 15% or more of a reduction ratio per pass at 1200° C. to Tnr and 30% or more of an accumulated reduction ratio; and were respectively subjected to a finished-rolling and cooling at the rolling and cooling conditions as listed in the following Table 2, to manufacture steel sheets.

Subsequently, with the manufactured steel sheets, the ferrite crystal size (FGS) and MA phase (martensite/austenite mixed structure) fraction were measured. In addition, in order to evaluate the material properties of the steel sheets, the tensile strength, yield strength, and low temperature impact toughness were measured. The results thereof are listed in the following Table 3.

At this time, for the ferrite crystal grain size (FGS), the specimens were taken after polishing the mirror surface of ¼ t the area of a steel sheet and were etched with an FGS corrosion solution. Subsequently, the specimens were observed at 500 times magnification using an optical microscope; then the crystal grain sizes were measured by image analysis; and finally, the average thereof was obtained.

For the fraction of the MA phase, the specimens were taken after polishing the mirror surface of ¼ t the area of a steel sheet and were corroded with a lapera corrosion solution. Subsequently, the specimens were observed at 500 times magnification using an optical microscope; and finally, the fraction of the MA phase was obtained by image analysis.

For the tensile strength, JIS4 specimens were taken in a vertical direction to the rolling direction of ¼ t the area of a steel sheet and were subjected to a tensile test at room temperature to measure tensile strength.

For the low temperature impact toughness, the specimens were taken in a vertical direction to the rolling direction of ¼ t the area of a steel sheet to manufacture V-notched specimens, then were subjected to a Charpy impact test at −75° C. five times, and the average thereof was obtained.

TABLE 1

| Types of Steels | C | Si | Mn | P | S | Al | Ni | Ti | Cu | Mo | Nb | Division |
|---|---|---|---|---|---|---|---|---|---|---|---|---|
| A | 0.04 | 0.40 | 1.5 | 0.010 | 0.003 | 0.05 | 0.4 | 0.015 | — | 0.1 | — | Invented Steel |
| B | 0.07 | 0.15 | 1.3 | 0.008 | 0.002 | 0.03 | 0.05 | 0.012 | 0.2 | — | 0.015 | Invented Steel |
| C | 0.1 | 0.20 | 1.3 | 0.005 | 0.002 | 0.03 | 0.3 | 0.015 | — | — | — | Invented Steel |
| D | 0.08 | 0.25 | 1.4 | 0.008 | 0.002 | 0.03 | 0.35 | 0.015 | — | — | 0.02 | Invented Steel |
| E | 0.015 | 0.20 | 1.2 | 0.010 | 0.003 | 0.03 | 0.5 | 0.015 | — | — | — | Comparative Steel |
| F | 0.2 | 0.20 | 1.3 | 0.008 | 0.002 | 0.02 | 0.2 | 0.013 | 0.2 | — | — | Comparative Steel |
| G | 0.1 | 0.40 | 3.0 | 0.010 | 0.005 | 0.025 | 0.2 | 0.013 | — | — | 0.02 | Comparative Steel |

TABLE 2

| Types of Steels | Division | | Ar3 (° C.) | Reduction Ratio per Pass (%) | Accumulated Reduction Ratio (%) | Temp. for Stopping Rolling (° C.) | Cooling Rate (° C./s) | Temp. for Stopping Cooling (° C.) |
|---|---|---|---|---|---|---|---|---|
| A | A-1 | Invented Material | 755 | 20 | 60 | 790 | 15 | 450 |
| | A-2 | Invented Material | 755 | 15 | 65 | 830 | 10 | 500 |
| | A-3 | Invented Material | 755 | 15 | 65 | 820 | 10 | 400 |
| | A-4 | Com. Material | 755 | 15 | 65 | 800 | 20 | 650 |
| | A-5 | Com. Material | 755 | 15 | 65 | 800 | 4 | 400 |
| | A-6 | Com. Material | 755 | 15 | 70 | 880 | 20 | 500 |
| | A-7 | Com. Material | 755 | 15 | 40 | 800 | 15 | 520 |
| | A-8 | Com. Material | 755 | 5 | 60 | 800 | 10 | 430 |
| B | B-1 | Invented Material | 785 | 20 | 60 | 825 | 15 | 450 |
| | B-2 | Invented Material | 785 | 15 | 65 | 835 | 10 | 500 |
| | B-3 | Invented Material | 785 | 15 | 65 | 835 | 10 | 400 |
| | B-4 | Com. Material | 785 | 15 | 65 | 835 | 20 | 650 |
| | B-5 | Com. Material | 785 | 15 | 65 | 835 | 4 | 400 |
| | B-6 | Com. Material | 785 | 15 | 70 | 905 | 20 | 500 |
| | B-7 | Com. Material | 785 | 15 | 40 | 835 | 15 | 520 |
| | B-8 | Com. Material | 785 | 5 | 60 | 835 | 10 | 430 |
| C | C-1 | Invented Material | 766 | 20 | 60 | 806 | 15 | 450 |
| | C-2 | Invented Material | 766 | 15 | 65 | 816 | 10 | 500 |

TABLE 2-continued

| Types of Steels | | Division | Ar3 (° C.) | Reduction Ratio per Pass (%) | Accumulated Reduction Ratio (%) | Temp. for Stopping Rolling (° C.) | Cooling Rate (° C./s) | Temp. for Stopping Cooling (° C.) |
|---|---|---|---|---|---|---|---|---|
| | C-3 | Invented Material | 766 | 15 | 65 | 816 | 10 | 400 |
| | C-4 | Com. Material | 766 | 15 | 65 | 816 | 20 | 650 |
| | C-5 | Com. Material | 766 | 15 | 65 | 816 | 4 | 400 |
| | C-6 | Com. Material | 766 | 15 | 70 | 886 | 20 | 500 |
| | C-7 | Com. Material | 766 | 15 | 40 | 816 | 15 | 520 |
| | C-8 | Com. Material | 766 | 5 | 60 | 835 | 10 | 430 |
| D | D-1 | Invented Material | 784 | 20 | 60 | 824 | 15 | 450 |
| | D-2 | Invented Material | 784 | 15 | 65 | 834 | 10 | 500 |
| | D-3 | Invented Material | 784 | 15 | 65 | 834 | 10 | 400 |
| | D-4 | Com. Material | 784 | 15 | 65 | 834 | 20 | 650 |
| | D-5 | Com. Material | 784 | 15 | 65 | 834 | 4 | 400 |
| | D-6 | Com. Material | 784 | 15 | 70 | 904 | 20 | 500 |
| | D-7 | Com. Material | 784 | 15 | 40 | 834 | 15 | 520 |
| | D-8 | Com. Material | 784 | 5 | 60 | 835 | 10 | 430 |
| E | E-1 | Com. Material | 790 | 20 | 60 | 830 | 15 | 450 |
| | E-2 | Com. Material | 790 | 15 | 65 | 840 | 10 | 500 |
| | E-3 | Com. Material | 790 | 15 | 65 | 840 | 10 | 400 |
| | E-4 | Com. Material | 790 | 15 | 65 | 840 | 20 | 650 |
| | E-5 | Com. Material | 790 | 15 | 65 | 840 | 4 | 400 |
| | E-6 | Com. Material | 790 | 15 | 70 | 910 | 20 | 500 |
| | E-7 | Com. Material | 790 | 15 | 40 | 840 | 15 | 520 |
| | E-8 | Com. Material | 790 | 5 | 60 | 835 | 10 | 430 |
| F | F-1 | Invented Material | 737 | 20 | 60 | 777 | 15 | 450 |
| | F-2 | Invented Material | 737 | 15 | 65 | 787 | 10 | 500 |
| | F-3 | Invented Material | 737 | 15 | 65 | 787 | 10 | 400 |
| | F-4 | Com. Material | 737 | 15 | 65 | 787 | 20 | 650 |
| | F-5 | Com. Material | 737 | 15 | 65 | 787 | 4 | 400 |
| | F-6 | Com. Material | 737 | 15 | 70 | 857 | 20 | 500 |
| | F-7 | Com. Material | 737 | 15 | 40 | 787 | 15 | 520 |
| | F-8 | Com. Material | 737 | 5 | 60 | 835 | 10 | 430 |
| G | G-1 | Com. Material | 636 | 20 | 60 | 676 | 15 | 450 |
| | G-2 | Com. Material | 636 | 15 | 65 | 686 | 10 | 500 |
| | G-3 | Com. Material | 636 | 15 | 65 | 686 | 10 | 400 |
| | G-4 | Com. Material | 636 | 15 | 65 | 686 | 20 | 650 |
| | G-5 | Com. Material | 636 | 15 | 65 | 686 | 4 | 400 |
| | G-6 | Com. Material | 636 | 15 | 70 | 756 | 20 | 500 |
| | G-7 | Com. Material | 636 | 15 | 40 | 686 | 15 | 520 |

TABLE 2-continued

| Types of Steels | | Division | Ar3 (° C.) | Reduction Ratio per Pass (%) | Accumulated Reduction Ratio (%) | Temp. for Stopping Rolling (° C.) | Cooling Rate (° C./s) | Temp. for Stopping Cooling (° C.) |
|---|---|---|---|---|---|---|---|---|
| | G-8 | Com. Material | 636 | 5 | 60 | 735 | 10 | 430 |

TABLE 3

| Types of Steels | | Division | Average FGS (μm) | MA Phase Fraction (%) | Tensile Strength (MPa) | Yield Strength (MPa) | Yield Ratio | CVN@−75° C. (J) |
|---|---|---|---|---|---|---|---|---|
| A | A-1 | Invented Material | 5 | 13 | 544 | 413 | 0.76 | 330 |
| | A-2 | Invented Material | 7 | 12 | 532 | 410 | 0.77 | 311 |
| | A-3 | Invented Material | 7 | 12 | 558 | 419 | 0.75 | 320 |
| | A-4 | Com. Material | 7 | 0 | 502 | 457 | 0.91 | 340 |
| | A-5 | Com. Material | 39 | 14 | 523 | 382 | 0.73 | 32 |
| | A-6 | Com. Material | 32 | 12 | 512 | 364 | 0.71 | 41 |
| | A-7 | Com. Material | 35 | 12 | 508 | 371 | 0.73 | 46 |
| | A-8 | Com. Material | 38 | 14 | 507 | 365 | 0.72 | 50 |
| B | B-1 | Invented Material | 3 | 15 | 573 | 424 | 0.74 | 289 |
| | B-2 | Invented Material | 6 | 14 | 582 | 437 | 0.75 | 281 |
| | B-3 | Invented Material | 8 | 14 | 576 | 420 | 0.73 | 263 |
| | B-4 | Com. Material | 9 | 0 | 532 | 452 | 0.85 | 305 |
| | B-5 | Com. Material | 32 | 16 | 543 | 386 | 0.71 | 23 |
| | B-6 | Com. Material | 34 | 14 | 552 | 381 | 0.69 | 33 |
| | B-7 | Com. Material | 29 | 14 | 541 | 384 | 0.71 | 46 |
| | B-8 | Com. Material | 21 | 16 | 551 | 386 | 0.70 | 39 |
| C | C-1 | Invented Material | 3 | 20 | 601 | 415 | 0.69 | 223 |
| | C-2 | Invented Material | 6 | 19 | 598 | 407 | 0.68 | 210 |
| | C-3 | Invented Material | 8 | 19 | 620 | 409 | 0.66 | 209 |
| | C-4 | Com. Material | 9 | 0 | 553 | 503 | 0.91 | 240 |
| | C-5 | Com. Material | 32 | 21 | 562 | 377 | 0.67 | 12 |
| | C-6 | Com. Material | 34 | 19 | 571 | 405 | 0.71 | 10 |
| | C-7 | Com. Material | 29 | 19 | 568 | 415 | 0.73 | 9 |
| | C-8 | Com. Material | 21 | 21 | 530 | 360 | 0.68 | 11 |
| D | D-1 | Invented Material | 4 | 18 | 568 | 409 | 0.72 | 200 |
| | D-2 | Invented Material | 9 | 17 | 577 | 421 | 0.73 | 195 |
| | D-3 | Invented Material | 10 | 17 | 571 | 405 | 0.71 | 177 |
| | D-4 | Com. Material | 9 | 0 | 527 | 464 | 0.88 | 203 |
| | D-5 | Com. Material | 32 | 19 | 538 | 371 | 0.69 | 5 |
| | D-6 | Com. Material | 34 | 17 | 547 | 366 | 0.67 | 10 |
| | D-7 | Com. Material | 29 | 17 | 536 | 370 | 0.69 | 16 |

TABLE 3-continued

| Types of Steels | | Division | Average FGS (μm) | MA Phase Fraction (%) | Tensile Strength (MPa) | Yield Strength (MPa) | Yield Ratio | CVN@−75° C. (J) |
|---|---|---|---|---|---|---|---|---|
| | D-8 | Com. Material | 21 | 19 | 546 | 371 | 0.68 | 10 |
| E | E-1 | Com. Material | 4 | 8 | 484 | 411 | 0.85 | 352 |
| | E-2 | Com. Material | 9 | 5 | 472 | 406 | 0.86 | 340 |
| | E-3 | Com. Material | 10 | 7 | 498 | 418 | 0.84 | 330 |
| | E-4 | Com. Material | 9 | 0 | 442 | 407 | 0.92 | 330 |
| | E-5 | Com. Material | 31 | 0 | 463 | 384 | 0.83 | 333 |
| | E-6 | Com. Material | 28 | 6 | 452 | 389 | 0.86 | 318 |
| | E-7 | Com. Material | 34 | 1 | 448 | 367 | 0.82 | 322 |
| | E-8 | Com. Material | 36 | 5 | 447 | 375 | 0.84 | 326 |
| F | F-1 | Com. Material | 4 | 43 | 771 | 501 | 0.65 | 20 |
| | F-2 | Com. Material | 9 | 42 | 768 | 492 | 0.64 | 33 |
| | F-3 | Com. Material | 10 | 42 | 790 | 490 | 0.62 | 41 |
| | F-4 | Com. Material | 9 | 0 | 723 | 629 | 0.87 | 52 |
| | F-5 | Com. Material | 31 | 44 | 732 | 461 | 0.63 | 10 |
| | F-6 | Com. Material | 29 | 42 | 741 | 496 | 0.67 | 13 |
| | F-7 | Com. Material | 35 | 42 | 738 | 509 | 0.69 | 8 |
| | F-8 | Com. Material | 34 | 44 | 732 | 468 | 0.64 | 14 |
| G | G-1 | Com. Material | 4 | 46 | 721 | 461 | 0.64 | 19 |
| | G-2 | Com. Material | 4 | 45 | 718 | 452 | 0.63 | 16 |
| | G-3 | Com. Material | 6 | 45 | 740 | 451 | 0.61 | 33 |
| | G-4 | Com. Material | 5 | 2 | 673 | 579 | 0.86 | 45 |
| | G-5 | Com. Material | 21 | 47 | 682 | 423 | 0.62 | 12 |
| | G-6 | Com. Material | 16 | 45 | 691 | 456 | 0.66 | 9 |
| | G-7 | Com. Material | 13 | 45 | 688 | 468 | 0.68 | 12 |
| | G-8 | Com. Material | 12 | 47 | 682 | 430 | 0.63 | 7 |

Figure 2:
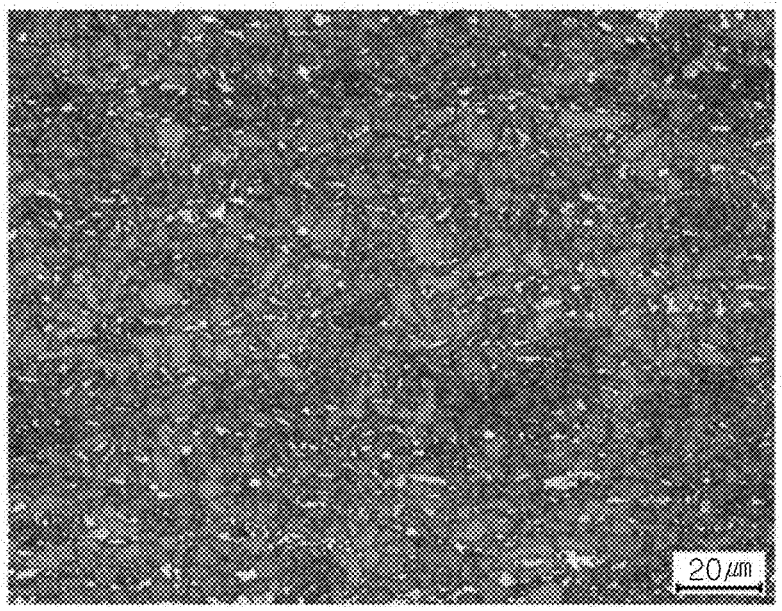
FIG. 2 illustrates the result of observing the shapes of the ultrafine MA phase (martensite/austenite mixed structure) of Invented Material B-1 with a microscope after Invented Material B-1 is lapera-etched.

As listed in the above Tables 1 to 3, it can be confirmed that the Invented Materials that satisfied the component compositions and manufacturing conditions suggested in the present invention were the steels having high strength and high toughness properties, and also, 0.8 or less of a yield ratio, a low yield ratio. In addition, as a result of observing the microstructure of Invented Material B-1 with a microscope, as illustrated in FIG. 1, it could be confirmed that ultrafine ferrite shapes were observed. As illustrated in FIG. 2, it could be confirmed that the MA phases (martensite/austenite mixed structure) were formed in a ferrite matrix.

However, in the cases of Comparative Materials E-4 to E-8 that did not satisfy the component compositions and manufacturing conditions suggested in the present invention, the ferrite crystal grain sizes were too rough, it was difficult to secure the sufficient MA phases, and thereby, high strength was not secured. Therefore, the low yield ratios were not obtained. In addition, in the cases of Comparative Materials F-4 to F-8 and G-4 to G-8, the ferrite crystal sizes were too rough, the MA phases were excessively formed, and thereby the low temperature toughness was not secured.

In addition, in the cases of Comparative Materials A-4 to A-8, B-4 to B-8, C-4 to C-8, and D-1 to D-4 that satisfied the component compositions of the present invention but did not satisfy the manufacturing conditions of the present invention, the ferrite crystal grain sizes were too rough or the MA phases were not formed. Therefore, the low yield ration could not be obtained or the low temperature toughness could not be secured.

In addition, in the cases of Comparative Materials E-1 to E-4, F-1 to F-4, and G-1 to G-4 that satisfied the manufacturing conditions of the present invention but did not satisfy the component compositions of the present invention, the MA phases fractions were insufficient or excessively formed. Therefore, a low yield ratio could not be obtained, or low temperature toughness could not be secured.

The invention claimed is:

1. A high strength steel sheet comprising: 0.02 to 0.12 wt % of carbon (C), 0.5 to 2.0 wt % of manganese (Mn), 0.05 to 0.5 wt % of silicon (Si), 0.05 to 1.0 wt % of nickel (Ni), 0.005 to 0.1 wt % of titanium (Ti), 0.005 to 0.5 wt % of aluminum (Al), 0.015 wt % or less of phosphorus (P), 0.015 wt % or less of sulfur (S), and the balance of Fe and other inevitable impurities, wherein a microstructure formed throughout an entire thickness thereof consists of: 70% to 90% of ultrafine ferrite having 10 μm or less of a crystal grain size and 10% to 30% of MA (martensite/austenite) structure by area fraction, and a yield ratio (YS/TS) thereof is 0.8 or less.

2. The high strength steel sheet of claim 1, wherein the steel sheet further includes one or two or more selected from the group consisting of 0.01 to 0.5 wt % of copper (Cu), 0.005 to 0.1 wt % of niobium (Nb), and 0.005 to 0.5 wt % of molybdenum (Mo).

3. The high strength steel sheet of claim 1, wherein the MA (martensite/austenite) structure has 5 μm or less of an average grain size.

4. The high strength steel sheet of claim 1, wherein the steel sheet has 150 J or more of impact toughness at −75° C. and 530 MPa or more of tensile strength.

5. A method of manufacturing a high strength steel sheet, the method comprising:

heating a slab including 0.02 to 0.12 wt % of carbon (C), 0.5 to 2.0 wt % of manganese (Mn), 0.05 to 0.5 wt % of silicon (Si), 0.05 to 1.0 wt % of nickel (Ni), 0.005 to 0.1 wt % of titanium (Ti), 0.005 to 0.5 wt % of aluminum (Al), 0.015 wt % or less of phosphorus (P), 0.015 wt % or less of sulfur (S), and a balance of Fe and other inevitable impurities;

rough-rolling the heated slab to form a rough-rolled slab having an average crystal grain size of austenite of 40 ▯m or less;

finish-rolling the rough-rolled slab to form a finish-rolled steel sheet having a matrix structure, the matrix structure being formed of ferrite having an average crystal grain size of 10 μm or less;

after the finish-rolling, maintaining the finish-rolled steel sheet for 30 to 90 seconds to form a maintained steel sheet; and cooling the maintained steel sheet to form a steel sheet having a microstructure consisting of: 70% to 90% of ultrafine ferrite having 10 m or less of a crystal grain size and 10% to 30% of MA (martensite/austenite) structure by area fraction throughout an entire thickness of the finish-rolled steel sheet, and a yield ratio (YS/TS) thereof is 0.8 or less.

6. The method of claim 5, wherein the slab further includes one or two or more selected from the group consisting of 0.01 to 0.5 wt % of copper (Cu), 0.005 to 0.1 wt % of niobium (Nb), and 0.005 to 0.5 wt % of molybdenum (Mo).

7. The method of claim 5, wherein the heating is performed at 1000° C. to 1200° C.

8. The method of claim 5, wherein the rough-rolling is performed at 1200° C. to austenite recrystallization temperature (Tnr).

9. The method of claim 5, wherein the rough-rolling is performed at 15% or more of a reduction ratio per pass and 30% or more of an accumulated reduction ratio.

10. The method of claim 5, wherein the finish-rolling is performed at (Ar3+30° C.) to (Ar3+100° C.).

11. The method of claim 5, wherein the finish-rolling is performed at 10% or more of a reduction ratio per pass and 60% or more of an accumulated reduction ratio.

12. The method of claim 5, wherein the cooling is performed at 300° C. to 500° C. with a cooling rate of 10° C./s or more.

13. The method of claim 5, wherein the MA (martensite/austenite) structure has an average grain size of 5 μm or less.

14. The method of claim 5, wherein the steel sheet has 150 J or more of impact toughness and 530 MPa or more of tensile strength.

* * * * *